US008608003B2

(12) United States Patent
Uno

(10) Patent No.: US 8,608,003 B2
(45) Date of Patent: Dec. 17, 2013

(54) KNOCKDOWN CONTAINER

(75) Inventor: Akinobu Uno, Takarazuka (JP)

(73) Assignee: Kyoraku Co., Ltd., Kyoto-shi, Kyoto (JP)

( * ) Notice: Subject to any disclaimer, the term of this patent is extended or adjusted under 35 U.S.C. 154(b) by 1329 days.

(21) Appl. No.: 12/310,630

(22) PCT Filed: Aug. 29, 2007

(86) PCT No.: PCT/JP2007/066810

§ 371 (c)(1),
(2), (4) Date: Feb. 27, 2009

(87) PCT Pub. No.: WO2008/026659

PCT Pub. Date: Mar. 6, 2008

(65) Prior Publication Data

US 2010/0224625 A1 Sep. 9, 2010

(30) Foreign Application Priority Data

Aug. 30, 2006 (JP) ..... 2006-232944

(51) Int. Cl.
*B65D 6/16* (2006.01)

(52) U.S. Cl.
USPC ..... 220/4.33; 220/4.01; 220/4.28; 220/4.08; 220/4.29; 220/4.34; 24/221 R; 24/287; 206/386; 206/206; 206/404; 206/503; 206/600; 410/70; 410/69; 410/80; D3/273

(58) Field of Classification Search
USPC ..... 220/4.01, 4.28, 4.33, 4.08, 4.29, 4.31, 220/4.34; 292/34, 37, 40, 92, 81.5; 403/258, 261, 321, 348, 388, 409.1; 410/100, 111, 116, 32, 69, 70, 77; 411/344, 345, 366.2, 45, 549
See application file for complete search history.

(56) References Cited

U.S. PATENT DOCUMENTS

| | | | | | |
|---|---|---|---|---|---|
| 1,735,926 | A | * | 11/1929 | Jandus | 411/366.2 |
| 3,815,772 | A | * | 6/1974 | Elmore et al. | 207/3 BC |
| 3,816,882 | A | * | 6/1974 | Maeda et al. | 411/549 |
| 4,109,789 | A | * | 8/1978 | Fattori et al. | 206/404 |
| 4,989,731 | A | | 2/1991 | Shuert | |
| 5,123,541 | A | * | 6/1992 | Giannini et al. | 206/600 |
| 5,133,460 | A | | 7/1992 | Shuert | |
| 5,775,860 | A | * | 7/1998 | Meyer | 411/46 |
| 5,899,337 | A | * | 5/1999 | Thebeault | 206/600 |

(Continued)

FOREIGN PATENT DOCUMENTS

| | | |
|---|---|---|
| JP | 57-101795 | 6/1982 |
| JP | 57-140322 | 9/1982 |

(Continued)

*Primary Examiner* — Anthony Stashick
*Assistant Examiner* — Cynthia Collado
(74) *Attorney, Agent, or Firm* — Flynn, Thiel, Boutell & Tanis, P.C.

(57) ABSTRACT

A knockdown container A having a hook member 4 attached to the sleeve 2 such as to be rotatable in a plane parallel to the surface of the sleeve 2, and a receptacle portion 12 formed in the pallet 1 to retain the hook member 4. Alternatively, a knockdown container A having a hook member 4 attached to the sleeve 2 such that it is accommodated in a cut-out portion 21 formed in the sleeve 2.

6 Claims, 7 Drawing Sheets

(56) References Cited

U.S. PATENT DOCUMENTS

| | | | | |
|---|---|---|---|---|
| 6,024,223 | A * | 2/2000 | Ritter | 206/600 |
| 6,234,315 | B1 * | 5/2001 | Karpisek | 206/600 |
| 6,994,226 | B2 | 2/2006 | Shuert | |
| 7,552,826 | B2 * | 6/2009 | Watanabe | 206/600 |
| 7,677,850 | B2 * | 3/2010 | Sano | 411/45 |

FOREIGN PATENT DOCUMENTS

| | | |
|---|---|---|
| JP | 06-504749 | 6/1994 |
| JP | 06-191604 | 7/1994 |
| JP | 06-263145 | 9/1994 |
| JP | 11-198936 | 7/1999 |

* cited by examiner

KNOCKDOWN CONTAINER

TECHNICAL FIELD

The present invention relates to a knockdown container, and more particularly to a knockdown container having fasteners attached on the surface of sleeves for fastening a pallet and the sleeves together.

BACKGROUND ART

Conventionally, knockdown containers consisting of a pallet that forms the bottom when transporting cargo, sleeves placed on grooves provided in the peripheral portions of the pallet to form side walls, and a lid part placed on top of the sleeves have been used.

Such conventional knockdown containers are provided with fastening mechanisms between the pallet and the sleeves to fasten them so that they do not come apart when the knockdown container is subjected to impact or the like during transport.

For example, in one such mechanism, as described in Patent Literature 1, a rod claw 100 is thrust out horizontally from a side wall of a groove portion formed in a pallet 300, to be inserted into a receptacle 201 formed in a sleeve 200, so that the sleeve 200 and the pallet 300 are fastened together (see FIG. 10). In this mechanism for fastening the sleeve 200, a knob portion 101 is formed to protrude at a base end of the rod claw 100 for preventing the once thrust-out rod claw 100 from easily coming off of the receptacle 201. That is, a transfer passage 301 in which this knob portion 101 slides is formed with a constricted part where the passage is partly narrower, so that, once the rod claw 100 is inserted into the receptacle 201 by forcibly thrusting the knob portion 101, the rod claw 100 does not readily come off of the receptacle 201 unless a force above a given magnitude is applied to the rod claw 100.

Patent Literature 1: Jpn. PCT National Publication No. 6-504749

DISCLOSURE OF THE INVENTION

However, repeated use of the knockdown container with the above-described fastening mechanism for a long time leads to a gradual increase in the width of the constricted part of the transfer passage 301 due to wear. As a result, even a slight impact may cause a displacement of the rod claw 100 (i.e., into a direction in which the rod claw is retracted into the pallet) and release thereof from the receptacle 201, leading to accidental disengagement of the pallet and the sleeve.

The transfer passage 301 is usually integrally formed with the pallet and when the constricted part is worn out, the transfer passage 301 alone cannot be replaced, meaning the whole pallet needs to be replaced with a new one, which is uneconomical.

Moreover, because of the design in which the above-noted rod claw 100 is disposed inside the pallet 300 such that it can freely slide along the transfer passage 301, the pallet itself in this part has a complex structure. To produce the pallet by molding using a metal mold, in particular, the mold needs to have a complex design with undercuts and the like, which imposes a large burden in terms of production costs. Furthermore, in such a structure wherein the rod claw 100 moves linearly in a horizontal direction and enters into the receptacle 201 of the sleeve 200, when the pallet 300 and the sleeve 200 are held together, the rod claw 100 is always subjected to bending stress. Because of this, when an impact or the like is applied to the container and a force is applied in a direction in which the pallet 300 and the sleeve 200 come apart, the rod claw 100 is bent, and afterwards it cannot be readily inserted into the receptacle 201 anymore, making the fastening operation difficult.

The present invention was devised to solve the above problems. Namely, its object is to provide a knockdown container with a pallet structure that can better withstand wear and the like and enable reliable fastening of a sleeve to the pallet.

The inventors of the present application have conducted rigorous studies on the basis of the background art and the problems described above, found out that the above problems can be solved by providing a structure in which a hook member is provided to the sleeve such as to be rotatable in a plane parallel to the surface of the sleeve and such that the hook member is retained in a receptacle in the pallet, and have completed the present invention based on this finding.

1) Namely, the present invention resides in a knockdown container including a pallet forming a bottom, a sleeve fitted to a groove provided in a peripheral portion of the pallet to form a side wall, and a lid part placed on top of the sleeve, wherein a hook member is attached to the sleeve such as to be rotatable in a plane parallel to a surface of the sleeve, and a receptacle portion in which the hook member is retained is formed in the pallet.

2) The present invention resides in the knockdown container as set forth in the above paragraph 1), wherein the hook member includes a claw portion at one end, and rotates around an axis provided at the other end thereof to cause the claw portion to be inserted in an opening of the receptacle portion so that the hook member is retained in the receptacle portion.

3) The present invention resides in the knockdown container as set forth in the above paragraph 2), wherein the hook member is provided with either one of a finger grip and a finger hole for allowing manual rotation thereof.

4) The present invention resides in the knockdown container as set forth in the above paragraph 1), wherein the hook member is attached to the sleeve such that it is accommodated in a cut-out portion formed in the sleeve.

5) The present invention resides in the knockdown container as set forth in the above paragraph 1), wherein the receptacle portion is formed inside the groove provided in the peripheral portion of the pallet.

6) The present invention resides in the knockdown container as set forth in the above paragraph 5), wherein the receptacle portion is formed by making a hole in part of a bulged portion provided inside the groove.

7) The present invention resides in a knockdown container characterized by having a hook member rotatably attached by a pivotal retention member consisting of a first anchoring member and a second anchoring member, the latter integrally rotating with the hook member, these first anchoring member and second anchoring member engaging with each other with a sleeve therebetween, and the first anchoring member including a latching projection that engages with a latching groove of the second anchoring member so that rotation of the hook member can be intermittently paused by a latching engagement between the projection and the groove.

8) The present invention resides in the knockdown container as set forth in the above paragraph 7), wherein a protective thin sheet is bonded to part of the sleeve that abuts on the hook member, part of the thin sheet being extended over an end face to a back side of the sleeve.

It should be understood that any combination of the features described above in the first to eight paragraphs that can achieve the object of the present invention can be adopted as well.

The knockdown container according to the present invention includes a pallet forming a bottom, a sleeve fitted to a groove provided in a peripheral portion of the pallet to form a side wall, and a lid part placed on top of the sleeve, wherein a hook member is attached to the sleeve such as to be rotatable in a plane parallel to a surface of the sleeve, and a receptacle portion in which the hook member is retained is formed in the pallet, whereby, even when a force is applied in a direction in which the sleeve comes apart from the pallet, the hook member is retained in the receptacle portion and prevents the sleeve from coming off of the pallet.

Moreover, since the hook member is provided separately from the sleeve, it can readily be replaced if it is broken or worn-out or the like. Unlike the conventional one, the pallet need not be entirely replaced every time the fastening mechanism becomes unusable, which is very economical. Since the claw portion attached to the sleeve is retained and fastened in the receptacle portion in the pallet, the hook member is not subjected to a bending force or wear. Also, because the hook member serves to pull the pallet to the sleeve, they can be held together more reliably.

Furthermore, since the hook member is attached to the sleeve such that it is accommodated inside the cut-out portion formed in the sleeve, the hook member does not protrude from the surface of the sleeve. Therefore, when fitting the sleeve into the groove formed in the pallet, the hook member does not get in the way, and there is no need to make the width of the groove larger than the thickness of the sleeve.

DESCRIPTION OF THE REFERENCE NUMERALS

Figure 1:
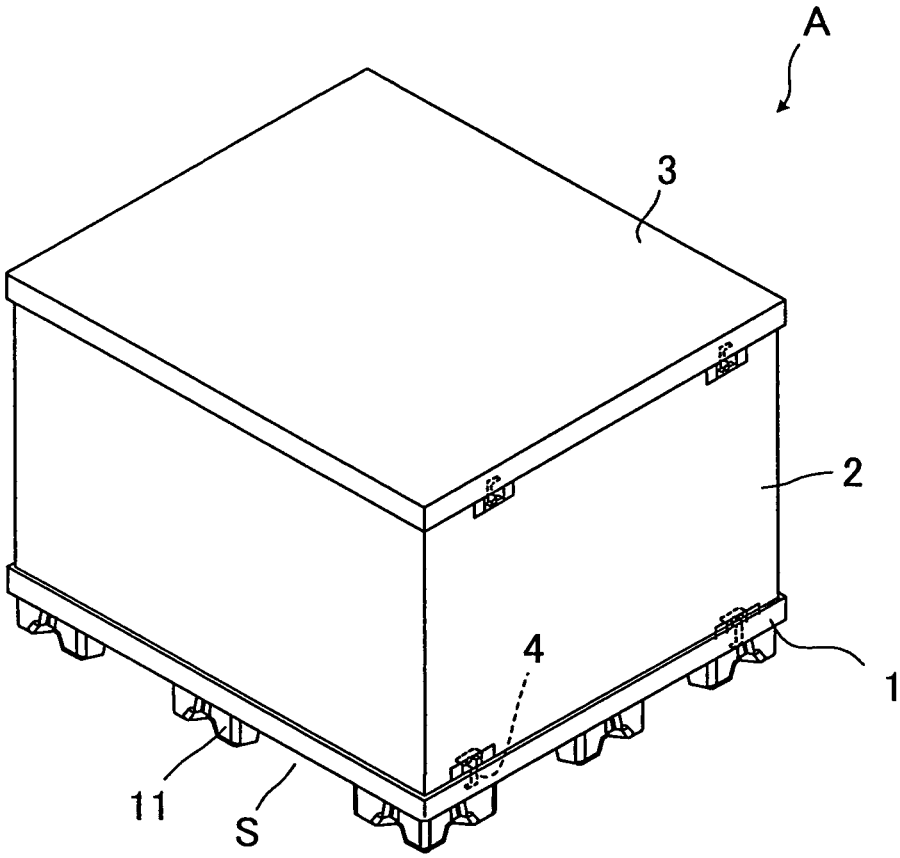
FIG. 1 is a schematic perspective view showing a knockdown container according to the embodiment of the invention.

1 pallet
11 leg portion
12 receptacle portion
13 bottom wall
14 bulged portion
2 sleeve
21 cut-out portion
22 through hole
3 lid part
4 hook member
41 arm portion
42 claw portion
42A wide surface portion
43 finger grip
44 cut-out portion
45 finger hole
5 attachment member
51 first plate member
51A bent portion
51B abutment portion
52 second plate member
52A female screw
6A first anchoring member
6A1 engaging member
6A2 latching member
6B second anchoring member
6B1 main body
F engaging projection
G latching projection
I latching groove
N screw
P mounting member
S space

BEST MODE FOR CARRYING OUT THE INVENTION (First Embodiment)

One embodiment of the present invention will be descried with reference to the drawings. FIG. 1 is a schematic perspective view showing a knockdown container according to this embodiment. As shown in FIG. 1, the knockdown container A according to this embodiment is made up of a pallet 1 forming a bottom, sleeves 2 fitted in grooves provided at the peripheral portions of the pallet to form side walls, and a lid part 3 placed on top of the sleeves. Hook members 4 are attached to each sleeve, while receptacle portions (not shown) are formed in the pallet 1 to retain the hook members 4.

The pallet 1 includes leg portions 11 to form a space S for allowing a forklift fork to enter therebelow. These leg portions 11 form a space S between the ground and the pallet 1, so that the fork can easily enter into the space S. To move the knockdown container A according to this embodiment, the fork is inserted into the above-noted space S, and the above-noted knockdown container including the pallet is entirely lifted up and moved.

Meanwhile, the pallet 1 is formed with grooves in its peripheral portions, and the sleeves 2 are fitted into and placed in these grooves in an upright manner. These grooves need only to be deep enough to provide secure support so that the sleeves 2 do not fall by their weight when they are placed on the grooves. In the bottom wall of each of these grooves, the receptacle portions are formed for retaining the hook members 4 which will be described later.

The material of the pallet 1 should not be limited to any particular type as long as it is a material that can withstand the weight of the cargo packed in the knockdown container A. For example, synthetic wood or plastic material or the like may be adopted. A plastic material, in particular, formed into a hollow double wall structure by blow molding, can constitute a lightweight and yet highly rigid pallet.

Meanwhile, the sleeves 2 are fitted into and placed in the grooves formed in the pallet 1 in an upright manner as noted above, thereby forming a cargo storage space inside. A larger height of the sleeves 2 can increase the volume of the knockdown container A itself, or on the contrary, a smaller height can decrease the volume of the knockdown container A itself.

For the material of the sleeves 2, cardboard, synthetic wood, plastic material or the like is used in order to reduce the weight of the knockdown container A. Sleeves made of cardboard would have an excellent storage efficiency as they would allow them to be easily folded right at the corners.

The sleeves 2 are formed with rectangular cut-out portions (not shown) to be described later. These portions will accommodate the hook members 4 that will be descried later.

The hook member 4 is attached to the sleeve 2 inside the cut-out portion using a mounting member P such that the hook member 4 is freely rotatable around the mounting member P (which may be a bolt or a screw or the like) as an axis in a plane parallel to the surface of the sleeve.

Figure 2:
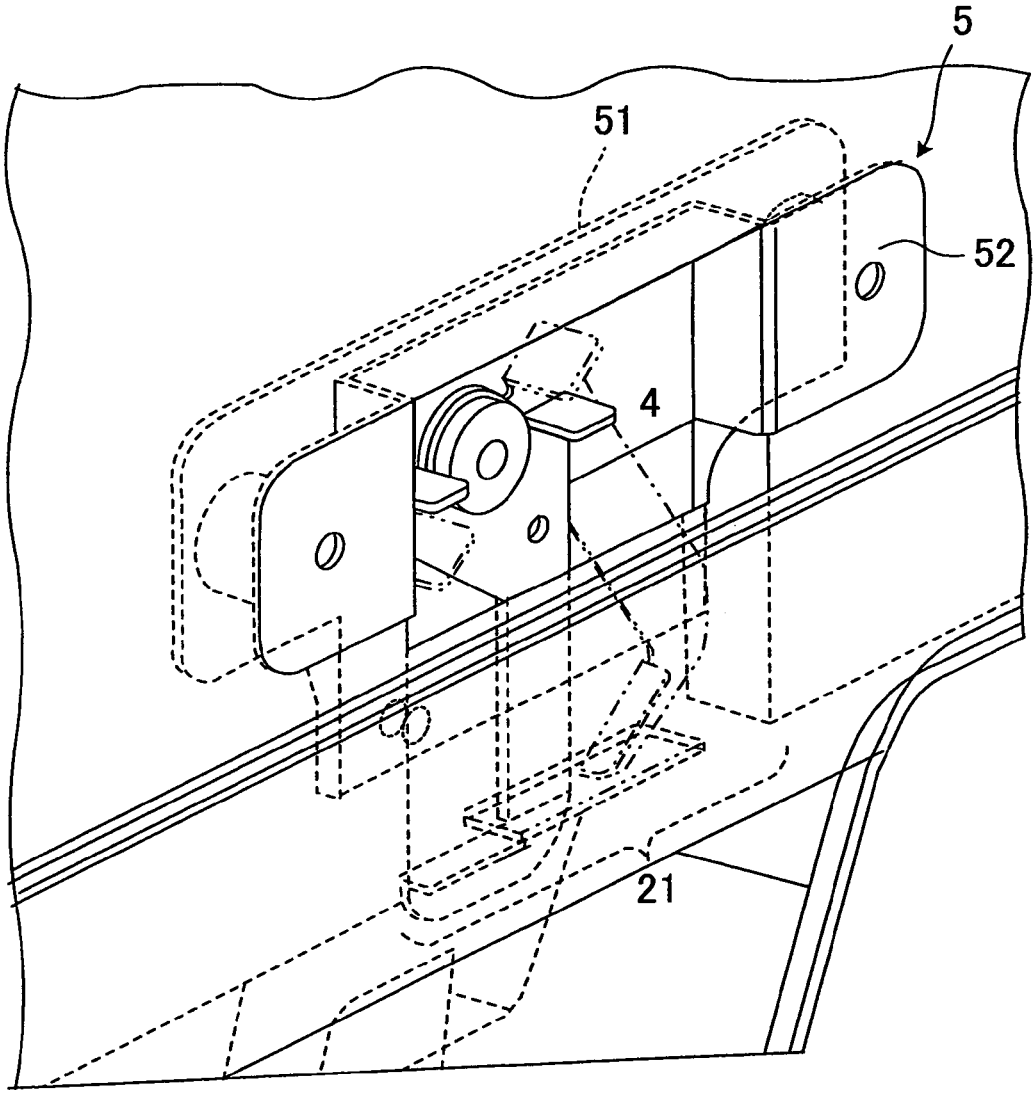
FIG. 2 is an explanatory diagram showing the relationship between a hook member and a receptacle portion viewed from an oblique angle.
Figure 3:
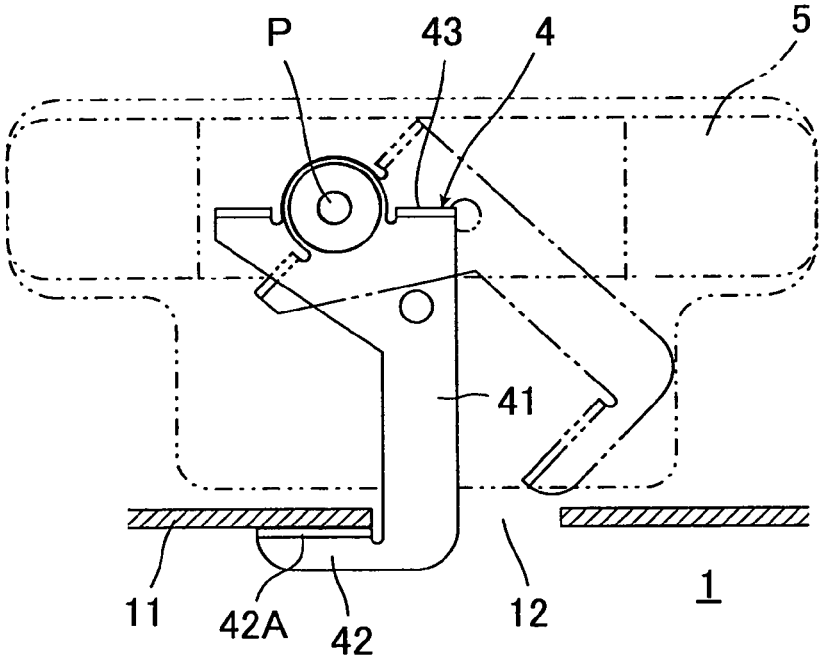
FIG. 3 is an explanatory diagram showing the relationship between the hook member and the receptacle portion viewed from the side.
Figure 4A:
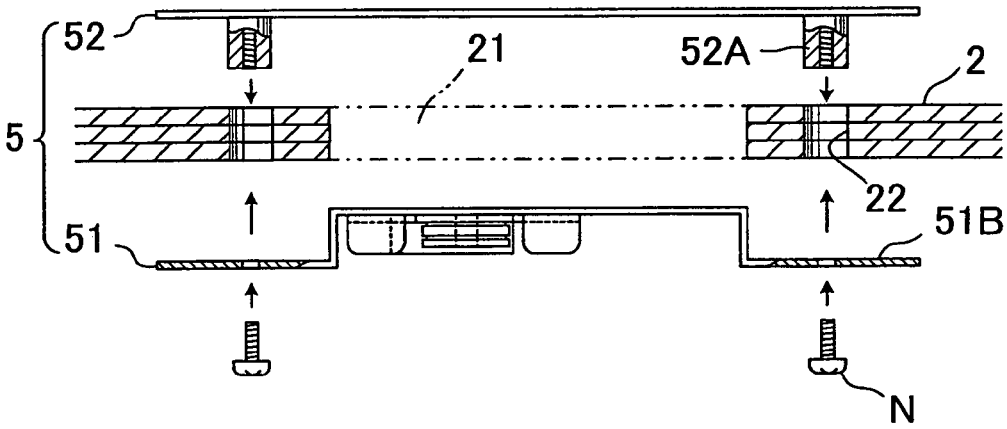
FIGS. 4(*a*) and (*b*) are explanatory diagrams showing one example of how an attachment member is attached to the sleeve.
Figure 4B:
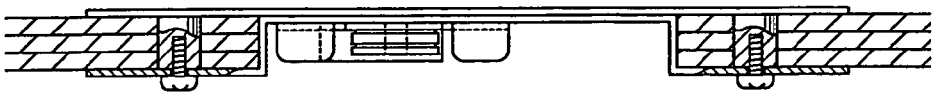

FIG. 2 is an explanatory diagram showing the relationship between the hook member and the receptacle portion viewed from an oblique angle. FIG. 3 is an explanatory diagram showing the relationship between the hook member and the receptacle portion viewed from the side. Further, FIGS. 4(*a*) and (*b*) are explanatory diagrams showing one example of how an attachment member is attached to the sleeve. As shown in FIG. 4(*a*), the attachment member 5 consists of a first plate member 51 which is in a folded shape and a second plate member 52 which is flat. Therefore, to attach the attachment member 5 to the sleeve 2, the first plate member 51 (more specifically abutment portion 51B) is abutted on the surface of the sleeve from the outer side of the sleeve 2, while the second plate member 52 is abutted on the sleeve surface from the inner side of the sleeve 2. Then, the bent portion 51A of the first plate member 51 fits right into the cut-out portion 21 of the sleeve 2 and protects and/or reinforces the periphery of the cut-out portion 21.

Female screws 52A protruded at both ends of the second plate member 52 are inserted into through holes 22 formed in the sleeve 2. Screws N are inserted from the side of the first plate member and fastened such that the sleeve 2 is fixedly held between the first plate member 51 and the second plate member 52 (see FIG. 4(*b*)). The attachment member 5, as it is attached as described above, does not protrude from the surface of the sleeve 2 and does not get in the way of anything.

The hook member 4 will be described in more detail. The hook member 4 has an arm portion 41 and a claw portion 42 at the distal end of the arm portion (see FIG. 2 and FIG. 3), and rotates around an axis at the other end. The claw portion 42 is inserted into the opening of the receptacle portion 12 formed in the pallet 1 and retained. The receptacle portion 12 is formed to open inside the groove of the pallet 1. The receptacle portion 12 is provided in a bulged portion (not shown) formed in the groove as will be described later so that the hook member can be attached to the sleeve such that it is accommodated in the cut-out portion in the sleeve without protruding from the lower end of the sleeve. The receptacle portion 12 can be easily formed to open in the bottom wall 13 of the pallet 1 by cutting away part thereof. In particular, for the pallet with a hollow double wall structure, the claw portion 42 is inserted into a hollow part and so is not therefore exposed to the outside of the pallet in a retained state, thereby preventing breakage or the like of the claw portion 42. The hook member 4 further includes a finger grip 43 to allow a user to easily rotate the hook member 4.

Normally, the hook member 4 is positioned in readiness at a slightly oblique angle relative to the cut-out portion 21 formed in the sleeve 2. Turning the hook member 4 clockwise in the drawing with fingers holding the finger grip 43 retains the claw portion 42 in the receptacle portion 12 with the hook member 4 in an upright position.

That is, the claw portion 42 comes to abut on the back side of the bottom wall 13 of the groove in the pallet to be retained thereby. Here, a wide surface portion 42A formed to the claw portion 42 to have a wider area than the arm portion 41 abuts on the back side of the bottom wall 13, whereby the claw portion 42 serves to support the back side of the bottom wall 13, making pressure contact therewith over a given area. This prevents the claw portion from creating a dent or the like in the bottom wall 13, and securely fastens the pallet 1 and the sleeve 2 together, so that there is no looseness or the like in the up and down direction of the sleeve 2.

Meanwhile, the lid part 3 is formed with grooves in the peripheral portions similarly to the pallet 1, and as the sleeves 2 fit into these grooves, the lid part 3 is stably supported on the sleeves 2.

Figure 5:
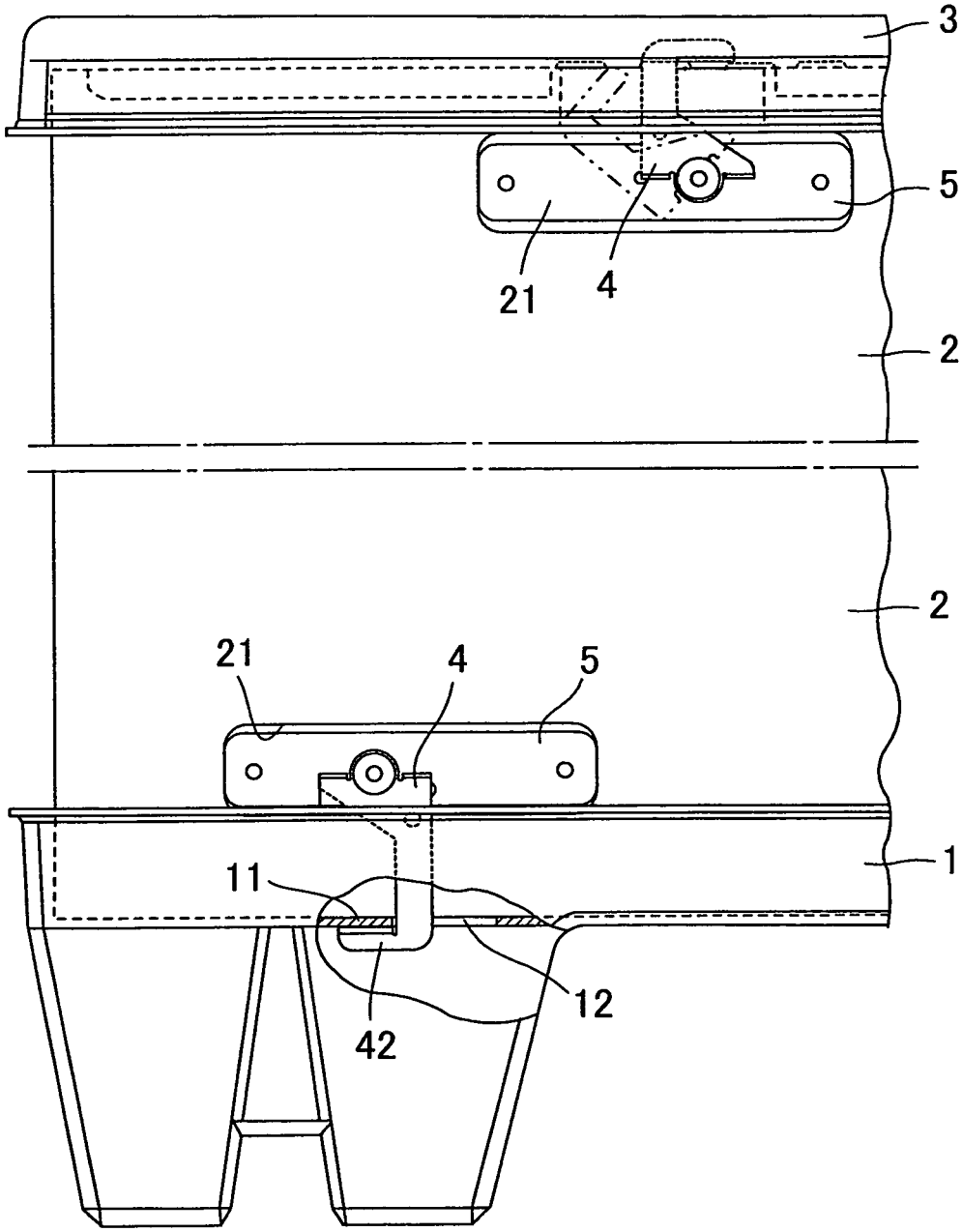
FIG. 5 is an explanatory diagram showing an example of a knockdown container having a fastening structure between the lid part and the sleeves 2.

This lid part 3 can also have the same fastening structure as the one provided between the pallet 1 and the sleeve 2 as described above. FIG. 5 shows an example of a knockdown container having the same fastening structure between the lid part 3 and the sleeve 2 as the one provided between the pallet 1 and the sleeve 2. Also, in this case, the grooves formed in the lid part 3 include receptacle portions, and the hook members 4 are attached at the upper end of the sleeves 2 via attachment members 5 such that they can be retained in the receptacle portions, whereby the sleeves 2 and the lid part 3 can be fastened together.

(Second Embodiment)

Figure 6:
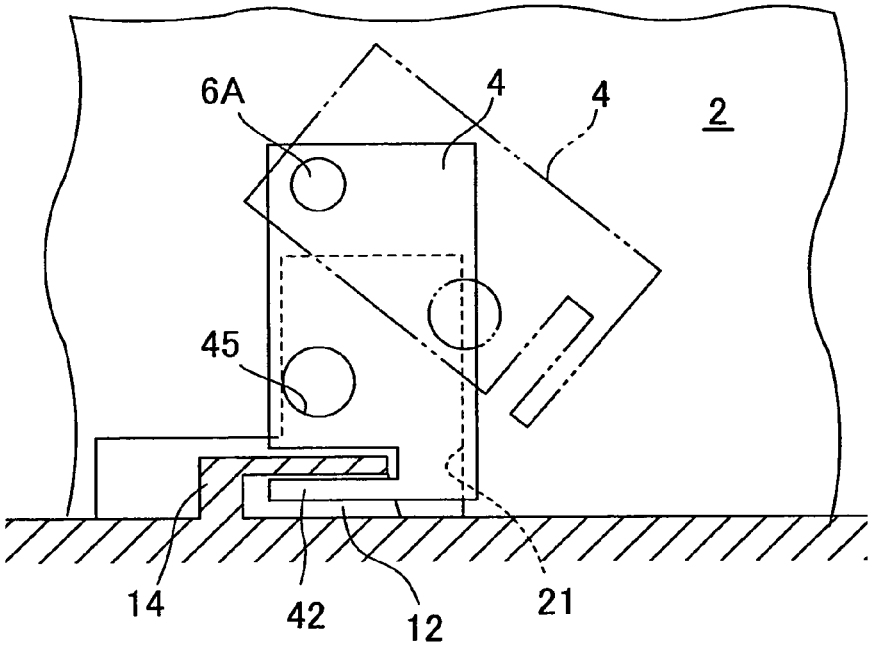
FIG. 6 is a schematic diagram showing, in enlargement, a state in the vicinity of the hook member in the knockdown container having hook members according to the embodiment of the invention.
Figure 7:
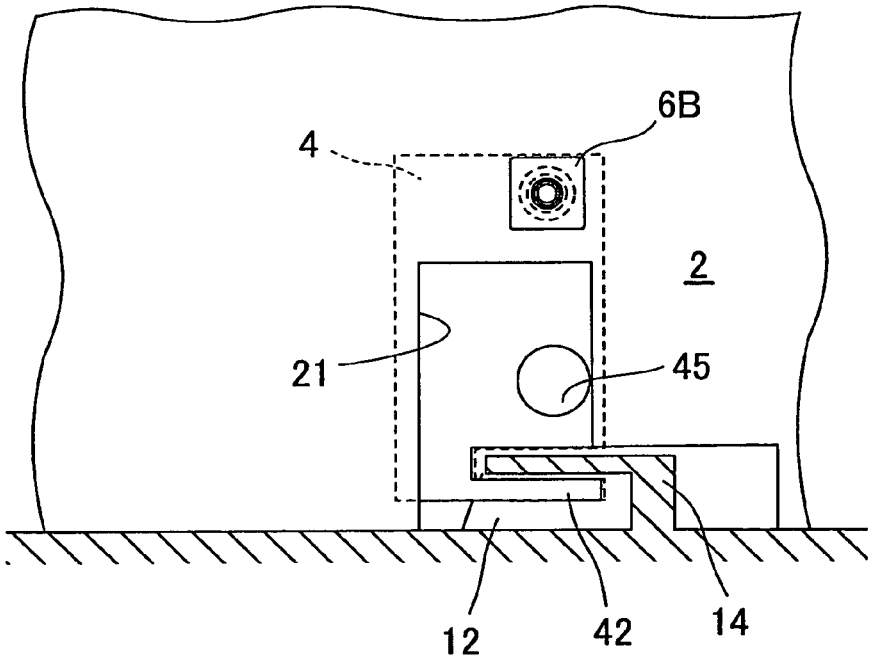
FIG. 7 is a schematic diagram showing the state of FIG. 6 viewed from the opposite side of the sleeve.

FIG. 6 is a schematic diagram showing, in enlargement, a state in the vicinity of the hook member in the knockdown container having hook members according to the embodiment of the invention. FIG. 7 is a schematic diagram of the state of FIG. 6 viewed from the opposite side of the sleeve. As shown in FIG. 6, the hook member 4 of the knockdown container with hook members according to this embodiment is in a rectangular plate shape, and the claw portion 42 is formed at the lower end of the hook member 4 by cutting away part thereof at a position a predetermined distance away from the bottom side of the hook member 4. Meanwhile, the receptacle portion 12 that engages with the claw portion 42 is formed in the pallet 1 as a tunnel-like opening in part of a bulged portion 14 protruded inside the groove, in which the sleeve 2 is fitted. The claw portion 42 engages with the receptacle portion 12 in the pallet 1 to fasten the pallet 1 and the sleeve 2 together. The hook member 4 is capable of rotating in a sliding manner on the surface of the sleeve by means of an anchoring member to be described later.

The hook member 4 is formed with a finger hole 45 into which a finger is inserted to rotate the hook member 4. In order to prevent injury to the finger at the edge of the finger hole 45, it is preferable to attach a cap to the finger hole 45. If the cap is attached, in order to prevent contact between the cap and the sleeve 2 and to prevent interference between the bulged portion 14 formed inside the groove and the lower end of the sleeve 2, it is preferable to form a cut-out portion 21 in the sleeve 2 (see FIG. 7). The hook member 4 is secured using a pivotal retention member such as to be rotatable along the sleeve 2.

Figure 8A:
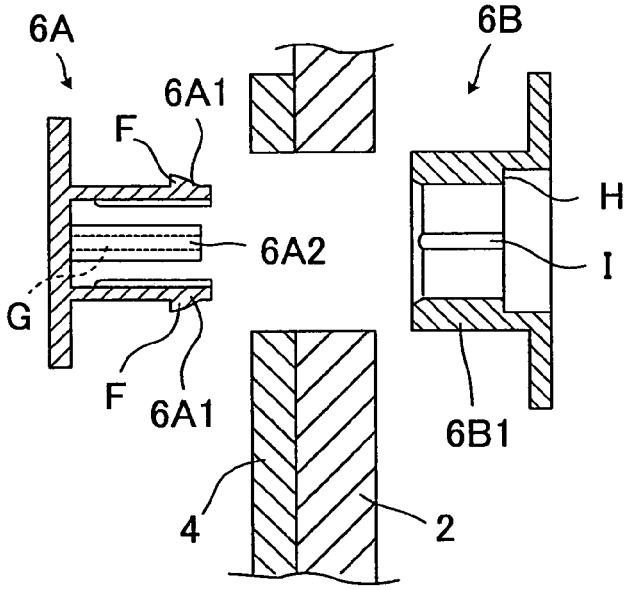
FIGS. 8(*a*) and (*b*) are cross-sectional views showing a state in which the hook member according to the embodiment of the invention is secured to the sleeve using an anchoring member.
Figure 8B:
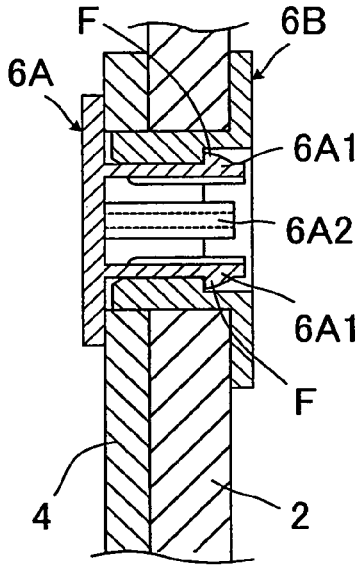

FIGS. 8(*a*) and (*b*) are cross-sectional views showing a state in which the hook member according to the embodiment of the invention is secured to the sleeve using the pivotal retention member. FIG. 8(*a*) is a cross-sectional view showing a state before a first anchoring member and a second anchoring member engage with each other, and FIG. 8(*b*) is a cross-sectional view showing a state after the first anchoring member and the second anchoring member have engaged with each other. As shown in FIG. 8(*a*), the pivotal retention member for securing the hook member 4 of the knockdown container with hook members to the sleeve 2 consists of a first anchoring member 6A and a second anchoring member 6B. The first and second anchoring members are engaged with each other with the sleeve between them.

As shown in FIG. 8(*b*), engaging members 6A1 of the first anchoring member 6A to be described later engage with a small diameter portion H of the second anchoring member 6B to be described later, whereby the first anchoring member 6A is retained and secured to the second anchoring member 6B. This retention mechanism is used to attach the hook member 4 to the sleeve 2. When the hook member 4 is attached to the sleeve 2, the first anchoring member 6A and the hook member 4 are integrally secured to each other by fitting or the like.

The first anchoring member 6A includes a pair of engaging members 6A1 and a pair of latching members 6A2 standing upright on a base plate in an annular arrangement, the pairs positioned in an intersecting relationship with each other. The engaging member 6A1 is formed with an engaging projection F for preventing the first anchoring member 6A from coming off of the second anchoring member 6B. The latching member 6A2 is formed with a latching projection G. The engagement that this latching projection G makes with a latching groove I of the second anchoring member 6B to be described later allows the user to rotate the hook member 4 intermittently and gives the user a so-called click feeling for each rotation.

Meanwhile, the second anchoring member 6B includes a cylindrical main body 6B1 and a flange part outwardly extending from the edge of the main body 6B1. The inner wall of the main body 6B1 is protruded to form the small diameter part H. A plurality of latching grooves I are formed in the small diameter part H to engage with the above-noted latching projection G, and in their opposite positions, another plurality of latching grooves I are formed.

Figure 9:
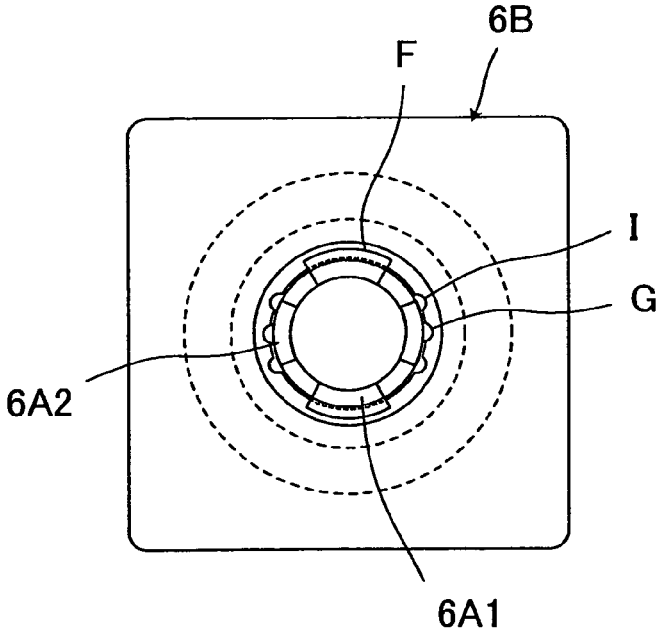
FIG. 9 is a front view showing a state in which a first anchoring member and a second anchoring member are coupled to each other.
Figure 10:
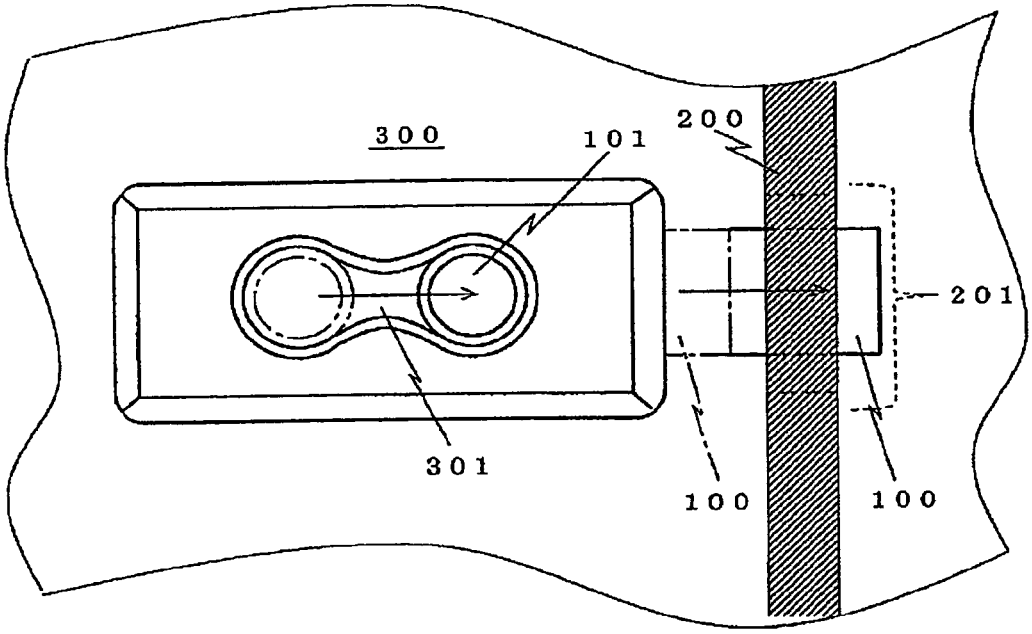
FIG. 10 is a schematic model diagram showing the vicinity of a knob portion of a conventional pallet.

FIG. 9 is a front view showing a state in which the first anchoring member and the second anchoring member are fitted to each other. As shown in FIG. 9, when the first anchoring member 6A and the second anchoring member 6B are fitted to each other, the engaging projections F on the engaging members 6A1 of the first anchoring member 6A engage with the edge of the small diameter part H of the second anchoring member 6B. As a result, the first anchoring member 6A is retained and secured to the second anchoring member 6B.

Meanwhile, the latching projections G on the latching members 6A2 of the first anchoring member 6A respectively engage with the latching grooves I in the second anchoring member 6B. Since the first anchoring member 6A moves integrally with the hook member 4, the latching projections G make engagement with the latching grooves I one after another as the hook member 4 is rotated. Therefore, the hook member 4 can be intermittently rotated, pausing at certain angular positions. These positions where the rotation of the hook member is paused should preferably be set at a position where the claw portion 42 of the hook member 4 has completely engaged with the receptacle portion 12 of the pallet 1 or a position where it is disengaged therefrom. In this embodiment, the sleeve 2 remains in contact with the hook member 4. Therefore, repeated rotation of the hook member 4 leads to wear on the abutting surfaces of the hook member 4 and the sleeve 2. To prevent such wear, it is preferable to bond a protective thin sheet on the abutting surfaces of the hook member 4 and the sleeve 2. Part of the thin sheet may be extended and bonded over an end face (normally a cut surface) of the sleeve 2 to the back side thereof, so that such end face is protected. This will also extensively maintain the strength of the end portion of the sleeve 2 if the sleeve 2 is made of cardboard.

This protective thin sheet can be printed with an arrow that indicates a rotation direction of the hook member 4, i.e., a locking or unlocking direction.

While the present invention has been described above in terms of specific embodiments, the present invention is not limited to these embodiments and may be embodied with various modifications. For example, a safety means may be provided that prevents rotation of the hook member 4 in a direction in which it comes off of the receptacle portion after the hook member 4 has been retained in the receptacle portion 12.

Further, while the attachment member shown here has a structure with two plate members, it may have a one-piece structure, and any other structures can be adopted as long as the hook member 4 can be rotatably supported in a stable manner.

The invention claimed is:

1. A knockdown container comprising a pallet forming a bottom, a sleeve fitted to a groove provided in a peripheral portion of the pallet to form a side wall, and a lid placed on top of the sleeve, characterized in that a hook member is attached to the sleeve by a pivotal retention member for rotating in a plane parallel to a surface of the sleeve, a receptacle portion in which the hook member is retained is formed in the pallet, the pivotal retention member consists of a first anchoring member and a second anchoring member, the first anchoring member integrally rotating with the hook member, the first and second anchoring members engaging with each other with a sleeve provided therebetween, the first anchoring member including a latching projection that engages with a latching groove of the second anchoring member and a latching engagement between the projection and the groove causes the hook member to be rotated such that the rotation of the hook member can be paused at a position where a claw portion formed at one end of the hook member has completely engaged with the receptacle portion of the pallet or a position where it is disengaged therefrom.

2. The knockdown container according to claim 1, wherein the hook member includes a claw portion at one end, and rotates around an axis provided at the other end thereof to cause the claw portion to be inserted in an opening of the receptacle portion so that the hook member is retained in the receptacle portion.

3. The knockdown container according to claim 2, wherein the hook member is provided with either one of a finger grip or a finger hole for allowing manual rotation thereof.

4. The knockdown container according to claim 1, wherein the hook member is attached to the sleeve such that it is accommodated in a cut-out portion formed in the sleeve.

5. The knockdown container according to claim 1, wherein the receptacle portion is formed inside the groove provided in the peripheral portion of the pallet.

6. The knockdown container according to claim 5, wherein the receptacle portion is formed by making a hole in part of a bulged portion provided inside the groove.

* * * * *